US006715805B1

(12) United States Patent
Ågren

(10) Patent No.: US 6,715,805 B1
(45) Date of Patent: Apr. 6, 2004

(54) LOCKING DEVICE AND A METHOD FOR MANUFACTURING THEREOF

(76) Inventor: Göran Ågren, Persborg 8, SE-805 95 Gävle (SE)

( * ) Notice: Subject to any disclaimer, the term of this patent is extended or adjusted under 35 U.S.C. 154(b) by 0 days.

(21) Appl. No.: 10/111,213

(22) PCT Filed: Oct. 23, 2000

(86) PCT No.: PCT/SE00/02047

§ 371 (c)(1),
(2), (4) Date: Oct. 1, 2002

(87) PCT Pub. No.: WO01/28872

PCT Pub. Date: Apr. 26, 2001

(30) Foreign Application Priority Data

Oct. 22, 1999 (SE) ..... 9903813

(51) Int. Cl.[7] ..... E05C 19/06

(52) U.S. Cl. ..... 292/91; 292/80; 292/128; 292/175; 292/228; 292/DIG. 64

(58) Field of Search ..... 292/91, 80, 81, 292/DIG. 64, 87, 128, 228, 175

(56) References Cited

U.S. PATENT DOCUMENTS

| | | | | | |
|---|---|---|---|---|---|
| 517,703 | A | * | 4/1894 | Ludwig | 292/87 |
| 2,100,644 | A | * | 11/1937 | Groves | 229/125.37 |
| 2,402,812 | A | * | 6/1946 | Gay | 292/81 |
| 2,572,159 | A | | 10/1951 | Kells et al. | |
| 3,215,327 | A | * | 11/1965 | Crabtree | 206/521.1 |
| 3,357,630 | A | | 12/1967 | Mechelitsch | |
| 3,458,108 | A | * | 7/1969 | Howarth et al. | 206/521.1 |
| 3,707,023 | A | | 12/1972 | Pfaffendorf et al. | |
| 4,463,894 | A | * | 8/1984 | Daines | 229/44 EC |
| 4,938,513 | A | * | 7/1990 | Gunderson | 292/80 |
| 5,318,218 | A | * | 6/1994 | Mattson | 229/117.24 |
| 5,358,291 | A | * | 10/1994 | Malmanger et al. | 292/175 |
| 5,452,845 | A | | 9/1995 | Ritter | |
| 5,507,428 | A | | 4/1996 | Robinson, Jr. et al. | |
| 5,634,675 | A | * | 6/1997 | Mo | 292/80 |
| 6,220,637 | B1 | * | 4/2001 | Kierl | 292/87 |

FOREIGN PATENT DOCUMENTS

| | | |
|---|---|---|
| DE | 2853983 | 6/1980 |
| DE | 8206873 | 6/1982 |
| DE | 3644145 | * 12/1987 |

* cited by examiner

*Primary Examiner*—Robert J. Sandy
*Assistant Examiner*—Carlos Lugo
(74) *Attorney, Agent, or Firm*—Dilworth & Barrese LLP.

(57) ABSTRACT

A locking device having a lock latch (5) which is movable between a first protruded lock position and a second withdrawn position. The locking device has an arm (7) and a flange (10). The arm (7), the flange (10) and the lock latch (5) are arranged in a way that the arm (7) turns backwards against action of a resilient force, looked at in relation to the front end of the lock latch, simultaneously as the look latch (5) is moved backwards towards the second position and the flange (10) turns in the same direction as the arm (7) when a pressure is exerted on the side of the arm (7) turned towards the flange (10), and that the arm (7) and the flange (10) turn forward and the lock latch (5) is moved forward towards the lock position during action of the resilient force when the pressure on the arm (7) decreases.

20 Claims, 3 Drawing Sheets

LOCKING DEVICE AND A METHOD FOR MANUFACTURING THEREOF

FIELD OF THE INVENTION AND PRIOR ART

The present invention relates to a locking device comprising a lock latch which is movable between a first protruded lock position and a second withdrawn position, and a method for producing such a locking device.

Locking devices which are intended to combine to that a closing member, such as a cap, remains in a closed position are known in a countless number of different types. In one of its simplest shapes such a locking device consists of a flange directed downwards and arranged at, the front edge of the closing member, which flange is intended to be moved down in front of a wall of for example a case or a box of paperboard material, at which the closing member is arranged, said closing member being firmly hold against the wall by means of a pressure force and/or friction force between the flange and the wall. This type of locking device gives a very unsatisfactory locking effect simultaneously as it may be difficult to obtain a sufficient grip of the closing member and/or the flange when the closing member is to be opened. Locking devices which have been designed to offer a safe locking effect at cases or boxes for instance have generally received a very complex construction and/or have been difficult for a user to manipulate between a locking and a releasing position.

THE OBJECT OF THE INVENTION

A first object with the present invention is to achieve a locking device, preferably for use in a closing member at a case or box construction, which gives a safe locking effect, i.e. in a safe way attend to that said closing member is held left in a closed position, simultaneously as the locking device may be manipulated in an easy way between a locking and a releasing position by the user.

A second object of the invention is to achieve a locking device which may be made of a light and inexpensive material simultaneously as it may be manipulated between a locking and a releasing position several times without being deformed in such an extent that it looses its locking capability.

A further object with the invention is to achieve a locking device which has a simple construction and may be produced in a rational way and with small expenses.

SUMMARY OF THE INVENTION

According to the invention said objects are obtained by means of a locking device described herein. A locking device constructed in accordance with the invention attains a safe locking capability in that the front part of the lock latch during action of a resilient force may be pushed into and held in a room of an object co-operating with the locking device. The arm easily accessible to the user, by means of which the lock latch is displaced between a lock position and a releasing position, contributes in that the locking device may be manipulated in an easy way between a locking and a releasing position by the user without the need of a big force.

According to a preferred embodiment one or more of the hinges that connect the parts included in the locking device are designed in such a way that they give rise to the resilient force which provides for that the lock latch is moved to the lock position and is held left in this lock position. By this, a force moving the lock latch is obtained in an easy and efficient way without the need of using separate springs or similar.

According to a particularly preferred embodiment of the invention, the arm has a length between a first and a second hinge which is longer than the length of the flange between a third and a fourth hinge. By this the lock latch will be directed obliquely upwards, looked at in the direction towards the front edge of the lock latch, towards the wall supporting the lock latch, which results in a further improved holding between the lock latch and the room of an object co-operating with the locking device and intended to receive the front part of the lock latch.

According to a particular embodiment of the invention the flange has a portion which extends below the front part or the lock latch protruding from the flange. In this way the user has to withdraw the flange by means of the arm and thereby the lock latch so far that the lower part of said flange portion runs clear from an adjacent wall or edge of the object co-operating with the locking device. Thus, this additional flange portion leads to that the flange and the lock latch have to be withdrawn a longer distance than what would be the case without this flange portion, wherefore the risk that the front part of the lock latch is pressed down against the upper side of said wall or edge and by that is broken or in another way is deformed decreases.

A locking device according to the invention may be made in an integral piece and therefore may be produced in a particularly easy way, for example such as defined in the description herein. This allows the locking device to be produced from the same piece and in the same process as the closing member, such as a cap of a case or a box, which is provided with the locking device. In the case that the object, such as a case or box at which the closing member is arranged, is produced of the same material as the closing member, for example from a paperboard material, it is also possible to produce the locking device, the closing member and said object from one and the same piece and in one and the same process. Since a locking device according to the invention may be manufactured in one piece of the same material as said object this locking device is suitable to use at an object of a reusable material.

The invention also relates to a closing member, for example in the shape of a cap, comprising a locking device according to the invention and a construction, for example in the shape of a case or a box, comprising such a closing member.

BRIEF DESCRIPTION OF THE DRAWING

With reference to the appended drawings, below follows a closer description of the invention by means of examples of embodiments. It is shown in.

DETAILED DESCRIPTION OF EMBODIMENTS

Figure 1:
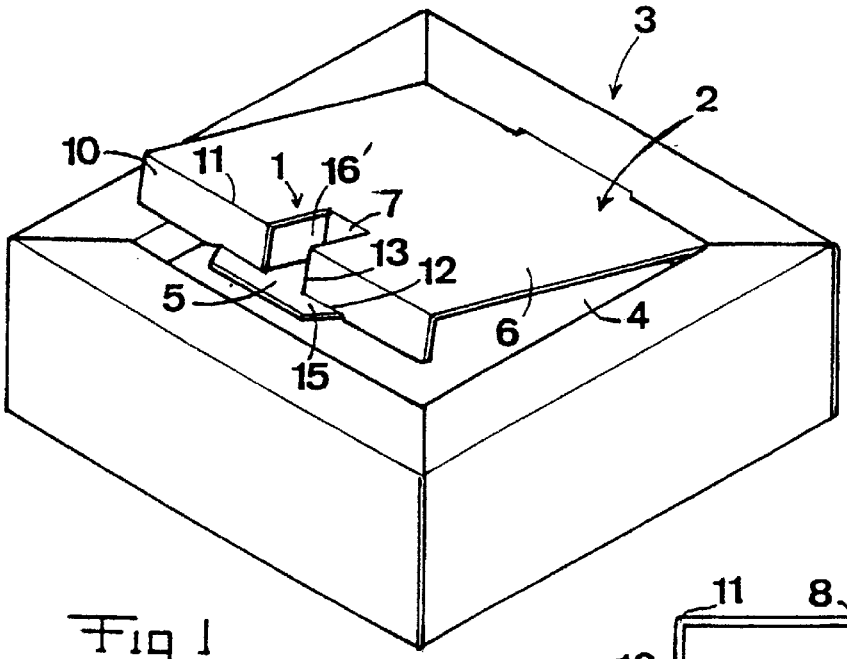
FIG. 1 in a perspective view obliquely from above, a case with a cap having a locking device according to a first embodiment of the invention, FIG. 2 in a lateral view, the locking device according to FIG. 1, FIG. 3 in a lateral view, the locking device according to FIG. 1 in the lock position and a part of the case co-operating with the locking device, FIG. 4 in a plane view, the locking device according to FIG. 1 before this has received its functional shape by bending, FIG. 5 in a lateral view, a locking device according to a second embodiment of the invention, FIG. 6 in a perspective view obliquely from above, a locking device according a third embodiment of the invention, FIG. 7 in a lateral view the locking device according to FIG. 6, FIG. 8 in a plane view, the locking device according to FIG. 6 before this has received its functional shape by bending, and FIG. 9 a lateral view similar to FIG. 3 and illustrating movement of the latch to a withdrawn position.

In FIG. 1 one embodiment of a locking device 1 according to the invention is illustrated, which locking device is arranged in a closing member in the shape of a cap 2, which cap 2 is intended to close an opening 4 of a case 3. A locking device according to the invention may also be arranged at some other type of a suitable closing member or similar and may be intended to co-operate with any type of object. However, said object is preferably constituted by any kind of box or case shaped construction. The cap 2 illustrated is moveably arranged at the case 3 and may be moved between an opened position and a position in which it closes the opening 4 of the case 3. In FIG. 1 the cap 2 is illustrated in a position partially opened. The locking device 1 is arranged at the free end of the cap 2 and comprises a lock latch 5. Said lock latch 5 is supported by a wall 6 integrated with the cap. Furthermore, the locking device 1 comprises an arm 7 having one end thereof attached to the wall 6 through a first hinge 8 and the other end thereof attached to the rear end of the lock latch 5 through a second hinge 9. At its edge turned towards the front end of the lock latch the wall 6 has a flange 10 which is attached to the wall 6 through a third hinge 11 and which is attached to a portion of the lock latch 5 at a distance from said third hinge 11 through a fourth hinge 12 at a distance in front of said second hinge 9. In the embodiment shown in FIG. 1 said third and fourth hinges 11, 12 each is divided in two portions with a portion arranged on each side of an opening 13 arranged in the flange 10. This opening 13 has mainly the same width as the lock latch 5 and the arm 7. The lock latch 5 has a front part 15 protruding from the flange 10 which part is intended to protrude into a room, receiving this lock latch part 15, of an object cooperating with the locking device in a lock position. In the example of the embodiment illustrated said room is constituted by a recess 16 (see FIG. 3) shaped in the case 3, which recess has a length that at least mainly corresponds to the width of the broadest portion of said lock latch part 15. Through the first and the second hinge 8,9 the arm 7 is pivotable in relation to the wall 6 and the lock latch 5, respectively, and through the third and the fourth hinge 11, 12 the flange 10 is pivotable in relation to the wall and the lock latch 5, respectively. The wall 6 has an opening 16' through which the arm 7 is accessible from the upper side of the wall. When a pressure is exerted on the side of the arm 7 turned towards the flange 10 this will turn backwards, looked at in relation to the front end of the lock latch, simultaneously as the lock latch 5 is moved backwards and the flange 10 turns in the same direction as the arm 7. At least one of said hinges 8, 9, 11, 12, preferably all of them, is designed in a way so that it gives rise to a resilient force which acts to bring the arm 7 and the flange 10 back towards to position they had before they were turned backwards during action of the pressure exerted on the arm 7, when the arm 7 and the flange 10 turn backwards in a way described above. It is also possible to let all hinges lack flexibility and instead provide the locking device with any kind of resilient member which is arranged to act against the arm 7 and/or the flange 10.

Figure 3:
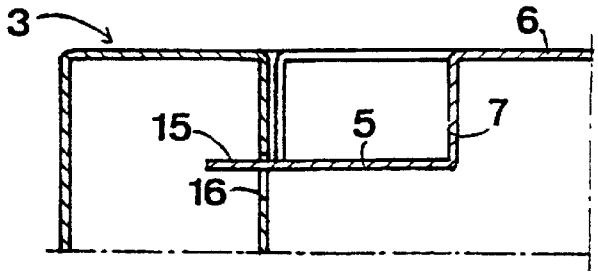

In FIG. 3 a lateral view of the locking device according to FIG. 1 in the lock position is illustrated, i.e. in the position when the cap 2 closes the opening 4 of the case 3. It is indicated in the figure that the front part 15 of the lock latch 5 protruding from the flange 10 protrudes into the recess 16 of the case 3. For opening of the cap 2 a pressure is exerted on the arm 7 through the opening 16 in the wall 6, said arm 7 and the flange 10 turning backwards, to the right in FIG. 3, against action of a resilient force in a way described above, simultaneously as the lock latch 5 is moved backwards. When the arm 7 and the flange 10 have turned backwards so far that the front part 15 of the lock latch is clear from the recess 16 the cap 2 is free to be opened. In this first example of embodiment the length of the arm 7 between the first and the second hinge 8, 9 is the same as the length of the flange 10 between the third and the fourth hinge 11, 12, wherefore the lock latch will move mainly in parallel with the wall 6 when the arm 7 and the flange 10 turn. It is obvious that the wall 6 and/or the lock latch 5 and/or the case 3 in the case illustrated must have a certain degree of flexibility so that the lock latch 5 will be able to run clear from the recess 16. Bringing the cap 2 and the locking device 1 back to the illustrated lock position is performed correspondingly. The locking device 1 is suitably designed in a way so that the resilient force mentioned above pushes the arm 7 and/or the flange 10 forwards, to the left in FIG. 3, in the illustrated lock position, whereby a good locking effect is secured. If the locking device is made of a material with suitable flexibility and shape rigidity the locking device may be manoeuvred between the protruded lock position and the withdrawn releasing position several times without being subject to a permanent deformation and with maintained locking capability.

Figure 2:
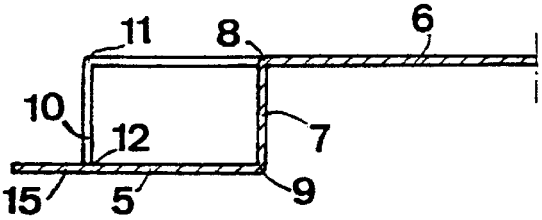
Figure 4:
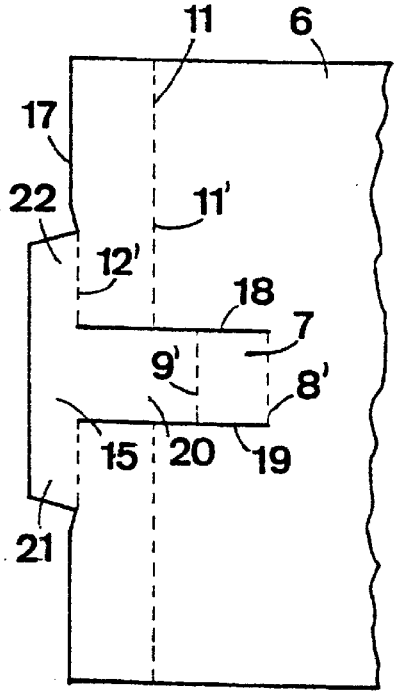

The locking device is, suitably made in one piece from a plate shaped material, preferably a paperboard material with certain stiffness. From this plate shaped material the parts included in the locking device 1 may be shaped through stamping and bending. In FIG. 4 a locking device according to FIG. 1 is illustrated after that the front part 15 of the lock latch has received its shape fixed by stamping. Also the lower edge 17 of the flange has been shaped by said stamping. From the figure it is clear that also the side edges of the lock latch 5 and the arm 7 have been created through two punched through cuts 18, 19. By way of bending the material along the bending lines 8', 9', 11', 12' indicated in FIG. 4 with dotted lines, the locking device 1 then receives its functional shape. Through these bendings the aforesaid hinges 8, 9, 11, 12 will be created at said bending lines 8', 9', 11', 12'. When the material is bent so that the locking device 1 is brought to take its functional shape illustrated in FIGS. 1–3 said openings 13, 16 in the flange 10 and the wall 6, respectively, are obtained automatically. If the bending is performed in a suitable way said hinges 8, 9, 11, 12 will have a resilient force which acts to bring the plate shaped material back towards the undeformed plane state.

In this embodiment the lock latch 5 comprises a first part 20 and a second front part 15 transversed in relation to the first part. The second front part 15 constitutes said front part of the lock latch and has two portions 21, 22 which protrude on each side of the first part 20. The first part 20 is through the rear end thereof attached to the arm 7 through said second hinge 9, and the second front part 15 is attached to the flange 10 at the rear edge of said two portions 21, 22 through said fourth hinge 12.

Figure 5:
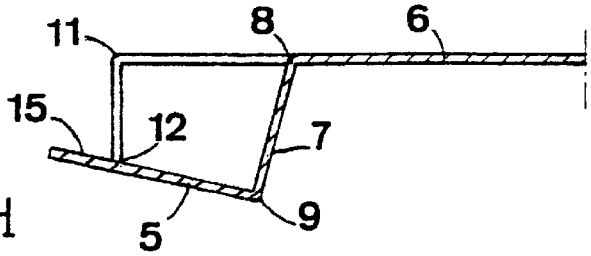

In FIG. 5 in a lateral view a second embodiment of a locking device according to the invention is illustrated. Here the arm 7 has a length between said first and said second hinge 8,9 which is longer than the length of the flange 10 between said third and fourth hinge 11, 12. In this way the lock latch 5 will be directed obliquely upwards, looked at in the direction towards the front edge of the lock latch, towards the wall 6, when being in its front lock position. By this, a stronger action of wedging between the lock latch 5 and the aforesaid recess 16 compared to the first embodiment is obtained. If this locking device is shaped from one and the same piece in a way mentioned above, the length between the first hinge 8 and the fourth hinge 12 via the third hinge 11 will be the same as the length between the first hinge 8 and the fourth hinge 12 via the second hinge 9.

Figure 6:
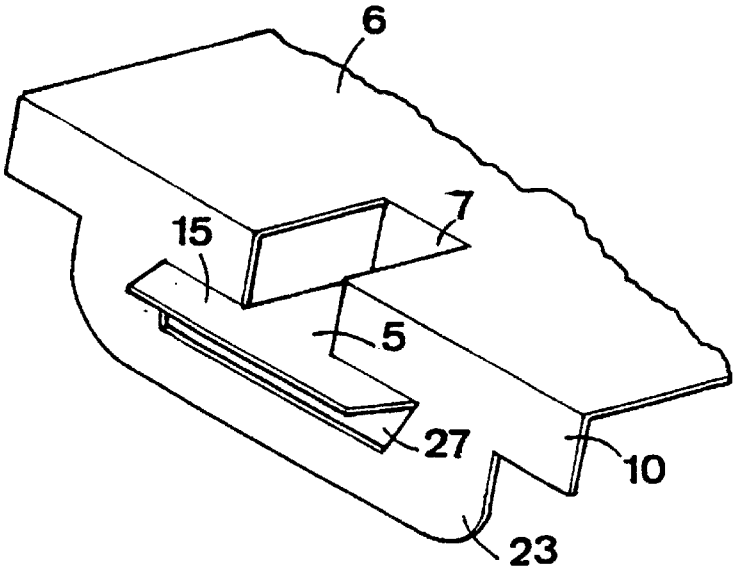
Figure 7:
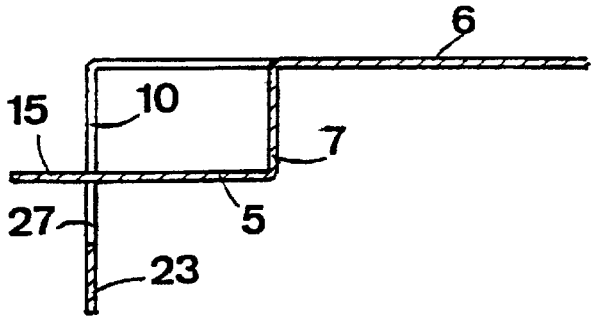
Figure 8:
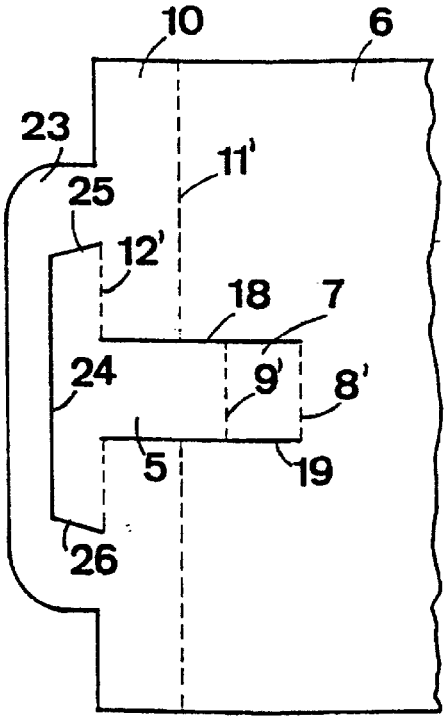
Figure 9:
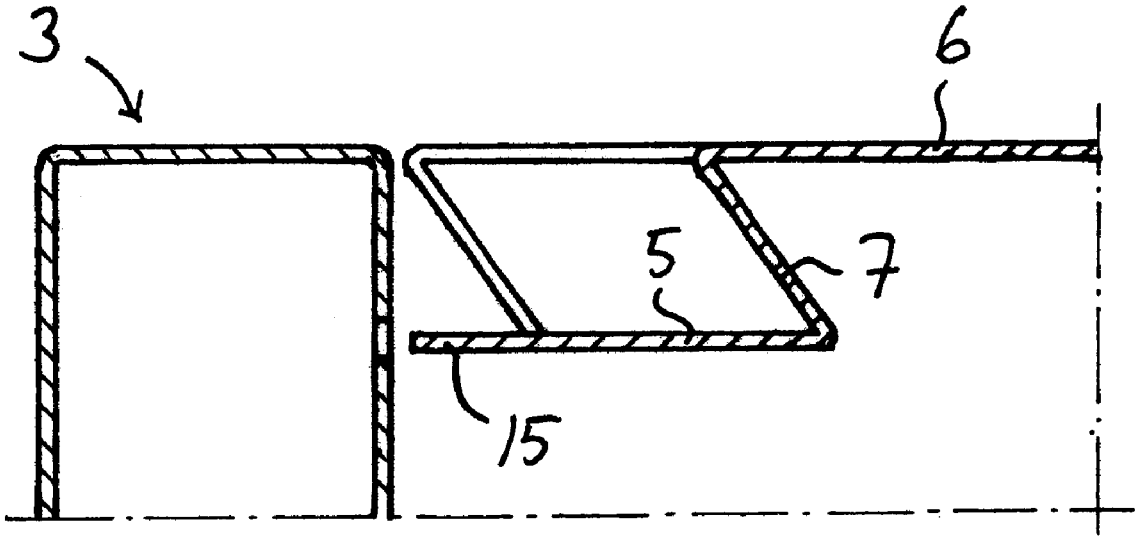

In the embodiment illustrated in FIG. 6 the flange 10 has portion 23 which extends below the front part 15 of the lock latch protruding from the flange. As is clearly indicated in the lateral view in FIG. 7 said portion 23 lies in the same plane as the rest of the flange 10. Also the locking device according to this third embodiment is suitably produced in one piece from a plate shaped material, said parts included in the locking device being suitably shaped by stamping and bending correspondingly to what is described in connection with FIG. 4. In this case the front part 15 of the lock latch is created by punched cuts 24–26 in the part that will create the flange 10, 23. By this, an opening 27 between the lock latch 5 and the portion 23 of the flange 10 which extends below the lock latch 5 appears after the bending process.

What is claimed is:

1. A locking device comprising a lock latch (5) which is movable between a first protruded lock position and a second withdrawn position, characterized in that the locking device (1) comprises an arm (7) having one end thereof through a first hinge (8) attached to the wall (6) supporting the lock latch (5) and the other end thereof through a second hinge (9) attached to a rear end of the lock latch (5) and a flange (10) connected with said wall (6) through a third hinge (11) and attached to a portion of the lock latch (5) at a distance from said third (11) hinge through a fourth hinge (12) at a distance in front of said second hinge (9), said lock latch (5) having a front part (15) protruding from the flange (10); in that the arm (7) and the flange (10) both protrude from one another and the same side of the wall (6) in the lock position and in said second position; in that the wall (6) has an opening (16) through which the arm (7) is accessible from the upper side of the wall; and that the arm (7), the flange (10) and the lock latch (5) are arranged in a way that the arm (7) turns backwards against action of a resilient force, locked at in relation to the front end of the lock latch, simultaneously as the lock latch (5) is moved backwards towards said second position and the flange (10) turns in the same direction as the arm (7) when a pressure is exerted on the same side of the arm (7) turned towards the flange (10) and that the arm (7) and flange (10) turn forward and the lock latch (5) is moved forward towards said lock position during action of the resilient force when the pressure on the arm (7) decreases.

2. A locking device according to claim 1, characterized in that one or more of said hinges (8, 9, 11, 12) are designed in a way so that they give rise to said resilient force when the arm (7) turns backwards.

3. A locking device according to claim 1, characterized in that the lock latch (5) comprises a first part (20) and a second part (15) transversed in relation to the first part and having two portions (21, 22) which protrude on each side of the first part (20), and said first part (20) is through the rear end thereof attached to the arm (7) through said second hinge (9), and the second part (15) at the rear edge of said two portions (21, 22) is attached to the flange (10) through said fourth hinge (12).

4. A locking device according to claim 1, characterized in that the arm (7) has a length between said first and second hinge (8, 9) which is longer than a length of the flange (10) between said third and fourth hinge (11, 12).

5. A locking device according to claim 1, characterized in that the flange (10) has a portion (23) which extends below said front part (15) of the lock latch protruding from the flange (10).

6. A locking device according to claim 1, characterized in that the locking device (1) is designed in an integral piece of a plate shaped material, said hinges (8, 9, 11, 12) being achieved by bending of the material.

7. A locking device according to claim 1, characterized in that the locking device (1) is made of paperboard material.

8. A method for producing the locking device according to claim 1, characterized in that the locking device (1) is made of a plate shaped material, said different parts and hinges of the locking device being achieved by stamping and bending of the material.

9. A method according to claim 8, characterized in that the arm (7) and the lock latch (5) are delimited by two punched cuts (18, 19) extending between said first hinge (8) and said fourth hinge (12).

10. A closing member comprising the locking device according to claim 1, wherein the closing member is in the shape of a cap for a box or case.

11. A construction comprising a closing member including the locking device according to claim 1, wherein the construction is in the shape of a box or a case and the closing member is in the shape of a cap.

12. A locking device according to claim 2, characterized in that the lock latch (5) comprises a first part (20) and a second part (15) transversed in relation to the first part and having two portions (21, 22) which protrude on each side of the first part (20), and said first part (20) is through the rear end thereof attached to the arm (7) through said second hinge (9), and the second part (15) at the rear edge of said two portions (21, 22) is attached to the flange (10) through said fourth hinge (12).

13. A locking device according to claim 2, characterized in that the arm (7) has a length between said first and second hinge (8, 9) which is longer than the length of the flange (10) between said third and fourth hinge (11, 12).

14. A locking device according to claim 3, characterized in that the arm (7) has a length between said first and second hinge (8, 9) which is longer than the length of the flange (10) between said third and fourth hinge (11, 12).

15. A locking device according to claim 12, characterized in that the arm (7) has a length between said first and second hinge (8, 9) which is longer than a length of the flange (10) between said third and fourth hinge (11, 12).

16. A locking device according to claim 2, characterized in that the flange (10) has a portion (23) which extends below said front part (15) of the lock latch protruding from the flange (10).

17. A locking device according to claim 3, characterized in that the flange (10) has a portion (23) which extends below said front part (15) of the lock latch protruding from the flange (10).

18. A locking device according to claim 4, characterized in that the flange (10) has a portion (23) which extends below said front part (15) of the lock latch protruding from the flange (10).

19. A locking device according to claim 12, characterized in that the flange (10) has a portion (23) which extends below said front part (15) of the lock latch protruding from the flange (10).

20. A locking device according to claim 13, characterized in that the flange (10) has a portion (23) which extends below said front part (15) of the lock latch protruding from the flange (10).

* * * * *